United States Patent [19]

Bofill et al.

[11] Patent Number: 4,921,439

[45] Date of Patent: May 1, 1990

[54] CENTER WIRE TRAP TERMINAL AND CONNECTOR

[75] Inventors: Pedro D. Bofill, Badalaona; Xavier C. Sole, Premia De Mar, both of Spain

[73] Assignee: AMP Incorporated, Harrisburg, Pa.

[21] Appl. No.: 375,804

[22] Filed: Jul. 5, 1989

[30] Foreign Application Priority Data

Oct. 27, 1988 [ES] Spain ..... 8803279

[51] Int. Cl.[5] ..... H01R 4/24

[52] U.S. Cl. ..... 439/417

[58] Field of Search ..... 439/417, 418, 436–441

[56] References Cited

U.S. PATENT DOCUMENTS

| | | | |
|---|---|---|---|
| 2,780,791 | 2/1957 | Morschel | 439/438 |
| 3,633,148 | 1/1972 | Thorsman | 439/438 |
| 3,989,336 | 11/1976 | Rizzio, Jr. et al. . | |
| 4,168,879 | 9/1979 | Ohtsuki et al. . | |
| 4,526,436 | 7/1985 | Aso . | |
| 4,629,271 | 12/1986 | Awano . | |
| 4,713,020 | 12/1987 | Awano et al. . | |
| 4,734,053 | 3/1988 | Imai . | |

FOREIGN PATENT DOCUMENTS

| | | |
|---|---|---|
| 8710741 | 8/1989 | Fed. Rep. of Germany . |
| 2039160 | 7/1980 | United Kingdom . |
| 2061634 | 1/1982 | United Kingdom . |

OTHER PUBLICATIONS

Molex 5494 Series.

*Primary Examiner*—Joseph H. McGlynn
*Attorney, Agent, or Firm*—William B. Noll

[57] ABSTRACT

An electrical connector assembly includes a base housing retaining terminals in housing cavities, said terminals including first cantilever spring arm portions extending along a given axis of said cavity and having second arm portion extending generally at right angles thereto; the assembly further including a cover adapted to be fitted on the housing and having internally thereof projections which cam the terminals into biting engagement with conductors inserted within the cavity as the cover projections are driven within the housing. Projections cooperate with slot means to alow the cover to be positioned in a first position allowing insertion and extraction of conductor with zero insertion and extraction forces and a second position latching the terminals into engagement therewith.

11 Claims, 4 Drawing Sheets

72
50'

90
88
94
96
50'
106
104
102
20'
100
110
108
112
114

50
124
126
140
138
132
20
130
122
120
128
134
136

50
156
166
158
164
150
152
154
20
160
162

CENTER WIRE TRAP TERMINAL AND CONNECTOR

BACKGROUND OF THE INVENTION

This invention relates to an electrical connector adapted to interconnect a stripped conductor to a terminal by finger pressure in a manner precluding accidental disengagement of the conductor with the terminal; and particularly to an electrical connector containing multiple terminals adapted to interconnect the conductors of a flat, flexible multi-conductor cable. The invention contemplates uses including the interconnection of multiple conductors to the multiple conductor traces as on a printed circuit board or the like.

Increasing density in electronic assemblies has brought forth a widespread use of multiple conductor cables wherein conductors are arrayed on fixed centers in a common insulating package which is typically flat. Cables are now being utilized which include conductors which are solid and round or solid and flat, and in many instances, conductors made of twisted, stranded wires which are tin plated and fused together to have the effect of solid wire.

The structure of flat cables does not readily accommodate to many types of termination, the most widely used being the so-called insulation displacement contact (IDC) which, although widely used, has a number of specific limitations including that of limitation on range of conductor gauge, such range typically being limited to two gauges.

A number of prior inventions have addressed this overall problem, including those shown in U.S. Pat. Nos. 3,989,336, 4,526,436 and 4,734,053, all being drawn to connector assemblies for interconnecting flat flexible multi-conductor cable to terminals. The present invention, while directed to generally the same problem addressed by these inventions, differs in a number of respects which will become apparent in the following description, including specifically a broader tolerance to both type of wire, round or flat, and diameter of wire or gauge range of wire accommodated as well as an improved wire retention and ease of utilization.

SUMMARY OF THE INVENTION

More specifically, the present invention comprises an electrical connector assembly including a housing of insulating material having a number of cavities formed therein extending along a given axis, the axis defining an axis of conductor insertion of the stripped conductors of a multi-wire cable. An electrical terminal stamped and formed to define a flat cantilever spring forming a first arm extending along the axis of the cavities in a generally vertical direction and having a flanged second arm extending roughly at right angles thereof containing an end adapted to engage the conductor inserted within a cavity upon such first and second arms being biased toward this conductor. The assembly includes a cover of insulating material having a series of internal projections on centers matching the centers of the housing cavities and oriented to engage the terminals upon insertion of the projections by driving the cover into the housing to bias the first and second arms toward the conductors inserted within the cavities for interconnection of the terminals with such conductors. The projections of the cover include cam surfaces providing a relatively low force requirement for displacement of the cover relative to the housing permitting the cover to be driven by finger pressure. The housing includes external projections oriented along the given axis to engage surfaces formed by slots in the cover the allow the cover to be positioned in an affixed manner with its projections out of bearing engagement with the terminals and a second position with the internal projections inserted within said housing to hold the terminal arm portions causing the ends of the second portions to remain in pressure engagement with the conductors within the assembly.

The angular relationship between the first and second arms of the terminal is such that the second arm is along an axis slightly downward with respect to the insertion of the conductors so that the edge thereof bites into the conductors and resists pullout of the conductors from the housing assembly. Each of the terminals includes a tab portion in the form of a leg which projects through the base of the housing to be interconnected to further circuit paths as by the insertion in a printed circuit board and soldering the engagement to the traces thereof.

In use, the connector assembly of the invention is typically soldered to a printed circuit board with the cover and housing in the first, or disengaged position, the stripped end of a multi-conductor cable is inserted within the housing, the conductors thereof extending into the cavities and the cover is displaced downwardly to cause engagement with the terminals and conductors and latch into position retaining such engagement under a substantial spring pressure. It should be noted that the insertion of the cable is with zero force, and that the extraction of such cable, by returning the cover to its original position, may be achieved by zero force.

DETAILED DESCRIPTION OF PREFERRED EMBODIMENT

Figure 1:
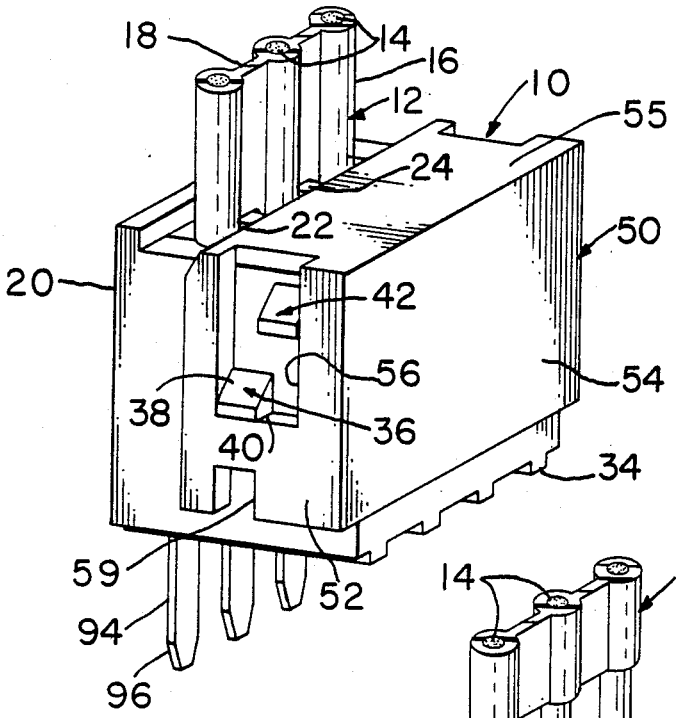
FIGS. 1 and 2 show the connector assembly of the present invention in conjunction with a multi-conductor cable, engaged and unengaged respectively.
Figure 2:
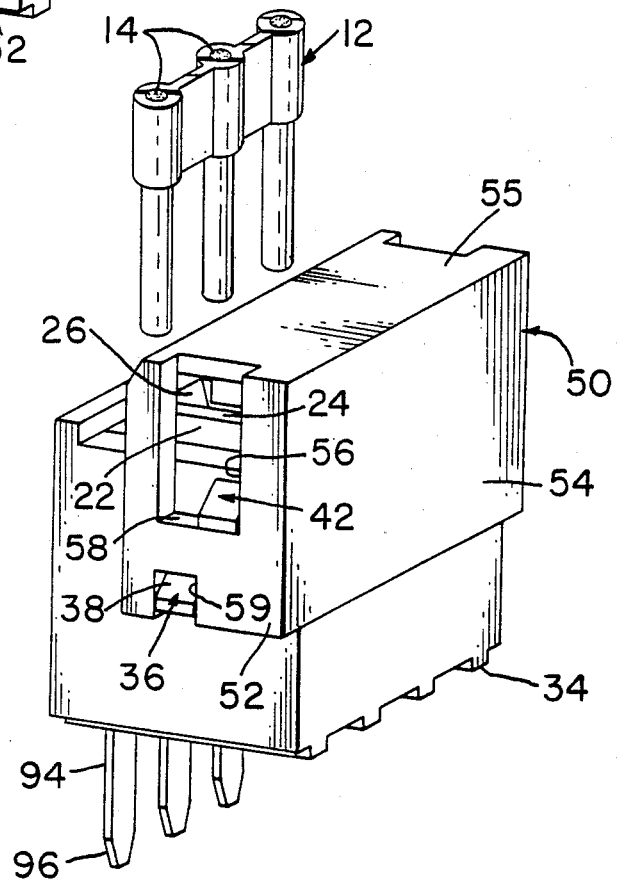
Figure 3:
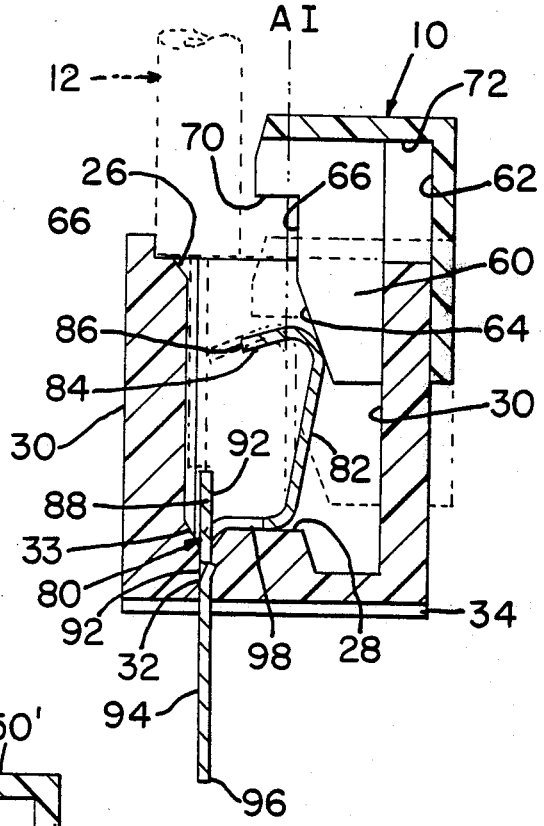
FIG. 3 shows the connector of FIGS. 1 and 2 in sectional elevation, the unengaged position of FIG. 2 being shown solidly and the engaged position of FIG. 1 being shown in phantom.

Referring now to the drawings and a first embodiment thereof, reference is made to FIGS. 1–3 wherein the connector assembly 10 is shown in engaged and disengaged conditions relative to a flat, flexible multi-conductor cable 12. The cable 12 may be seen to include conductors 14 which, in this particular example, are round with each having a jacket of insulating material shown as 16 with the conductors held on centers by a web of insulating material 18 extending between the jackets 16. Cable of this construction is widely used employing solid or stranded copper conductors frequently tin plated with the insulating material !6 and 18 being of common origin, typically extruded over the conductors in the manufacture of the cable. Such insulating material is typically polyvinyl chloride, polyethylene, or polypropylene. The cable conductors are made to have centers in accordance with the centers of the connector which in turn are typically ordered by the centers of the traces on the circuit board to be served by the connector assembly.

While the cable shown is a three-way multi-conductor flat flexible cable, it is, of course, contemplated that cables having more conductors or fewer conductors may be employed to advantage with the invention connector assembly, including specifically an application wherein a single conductor is adapted to a connector assembly having a single cavity and terminal or, in certain cases, with individual conductors utilized in a multi-cavity connector assembly in accordance with the invention.

It is further contemplated, and as will be revealed hereinafter, that cables having conductors of different gauge sizes may be utilized with essentially the same connector assembly and indeed, even cables having different conductor gauge sizes may be employed through techniques possible with the construction of the present invention.

FIG. 1 shows further the connector assembly 10 to be comprised of a base housing 20 and a cover fitted thereover shown as 50. The housing 20 and the cover 50 are preferably of molded plastic material having good dielectric and insulating properties, a preferably thermoplastic material to allow for give at the ends thereof for reasons that will be made apparent hereinafter.

As can be seen comparing FIG. 1 to FIG. 2 and revealed perhaps better in FIG. 3, the cover 50 has two positions with respect to the housing 20, a first position shown in FIG. 2 wherein the cover is withdrawn to an upward or disengaged position allowing insertion of the conductors 14 of cable 12 into a position as shown in FIG. 1 with the cover pressed downwardly to an engaged position to effect capture and termination of the conductors 14 of the cable 12.

The base housing 20 includes a number of details, including a series of cavities 22 defined by wall portions 24 extending therebetween and including wall portions 26 sloped at the entry of the cavities on one side to effectively guide insertion of the conductors within the cavities as well as a floor portion 28 as shown in FIG. 3 and a rear wall portion 30. The floor of the cavities of housing 20 includes apertures 32 in each cavity adapted to receive the insertion of a terminal therein, the upper portion of the floor portion 28 of cavity 22 being beveled as at 33 to facilitate such insertion. On the bottom of housing 20 are a series of standoffs 34 as shown in FIGS. 1 and 2 which hold the housing slightly off of a surface, such as a printed circuit board, to allow cleaning following a soldering operation, such cleaning being necessary to remove residuals of the soldering operation, including fluxes or other debris.

As shown in FIGS. 1 and 2, at the end of housing 20 are provided a pair of projections 36 and 42, each including as with respect to 36, a beveled or sloping surface 38 and a flat surface 40, it being understood that there is a similar pair of projections on the end opposite that shown in these figures with respect to the housing. These projections serve to position the cover 50 in either an engaged or disengaged position of assembly.

The housing cover 50 includes end walls 52, a rear wall 54, and a top wall 55, the remaining sides of the structure being open as indicated in FIG. 3. The end walls 52 include a first slot in each end shown as 56 terminated in a flat surface 58 and a further slot 59 in the bottom of each wall. These slots serve to hold the cover 50 in either the engaged or disengaged positions relative to the housing 20 in the manner shown in FIGS. 1 and 2. The end walls are made sufficiently flexible so that the cover may be forced down over the housing 20, the sloped surfaces 38 of the projections 36 facilitating such displacement of the end walls. This flexibility also allows removal of the cover 50 from housing 20.

As best seen in FIG. 3, the cover 50 is provided with a series of projections 60 spaced forwardly from the rear wall of the cover 54 to define a slot 62 which fits snugly over the rear wall 30 of housing 20. Each of the projections 60 is made on a center corresponding to the centers of the cavities 22 of the housing and each includes a first cam surface 64 followed by a flat vertical surface 66 and ending in a flanged surface 70 at right angles thereto. Interiorly of each cover is a flat surface 72 which is dimensioned and positioned to engage the top of the housing wall to limit downward displacement of the cover relative to the housing in the manner shown in phantom in FIG. 3

Figures 4, 6:
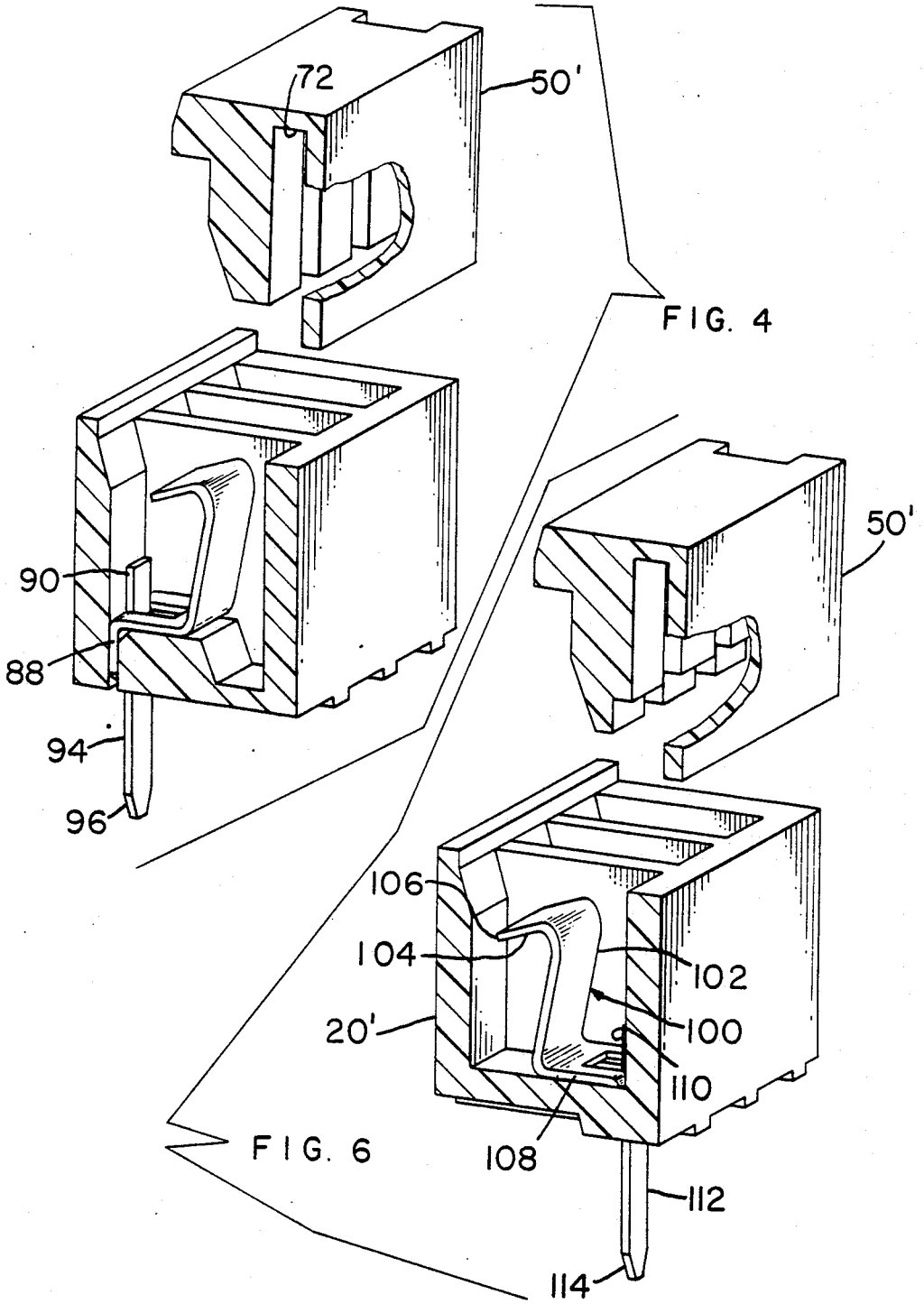
FIG. 4 shows the connectors of FIGS. 1–3 in perspective and partial section to illustrate details of terminal, cavities, and cover projections.
FIG. 6 shows the connector of FIG. 5 in perspective partially sectioned to reveal additional details of housing, cover, and terminal.

Within each cavity 22 of housing 20, there is disclosed an electrical terminal shown as 80 in FIG. 3 having a cantilever first arm portion extending vertically and shown as 82; or generally along the axis shown as AI which is the vertical axis of the cavity 22 as well as the axis of insertion of the cable conductors. The end region of arm 82 includes a flange portion 84 ending in a contact edge portion 86. These elements are of one piece, stamped and formed from conductive materials such as brass or phospherbronze to provide a spring structure extending from a base portion 88 which includes extending from the opposite end along the axis AI a portion including a lance 92 adapted to engage the housing aperture 32. A projection 90 as shown in FIG. 4 operates to stabilize terminal 80. Lance 92 serves to latch the terminal 80 in the housing against upward withdrawal, the bend shown as 98 precluding downward a displacement of the terminal relative thereto. Each terminal 80 further includes a tab portion 94 terminated as at 96 in a beveled portion adapted to facilitate a portion of the tab within the aperture of a circuit including circuit boards.

In operation with respect to the embodiment shown in FIGS. 1–4, the connector assembly 10 is typically preassembled, including the terminals in place as shown, and the cover 50 displaced upwardly in an disengaged position as shown in FIGS. 2 and 3, essentially locked in the upward position by virtue of the engagement of the end walls with the slots and projections as shown in FIG. 2. Next, the multi-wire cable, stripped as indicated, is inserted with the conductors 14 extended down within the cavities 22 of the housing 20. Appropriately, the cable 12 has been previously stripped of its insulation to provide a length of bare conductors 14 extending therefrom to extend well within the cavities in the manner indicated in FIG. 3. Thereafter, by displacing the cover 50 downwardly as by finger pressure, the projections 60 of the cover, operating through the cam surfaces 64, engage the terminals 80 at the curved portion between the first arm 82 and the second arm 84 to drive the spring portions in a relatively horizontal sense across so that the end portions 86 engage the conductors and bite into such conductors at an angle to resist axial displacement of the conductors out of the connector assembly. This is shown in phantom in FIG. 3. There is a flat surface as mentioned 66 on the projection 60 which, at a certain point, engages the side of first arm 82 as the cover is driven downwardly to its seated and latched position as shown in FIG. 1.

With respect to the contact assembly, it is contemplated that the cover projections may be molded to be individually dimensioned to accommodate for differently sized conductors. Certain of the conductors of a multi-wire cable may accordingly be made relatively large to accommodate the higher currents of power and grounding requirements with others of the conductors made relatively small to accommodate the lower current requirements of signals or signal circuits. In this way, a system may be designed including the cable itself placing the signal, ground, and power conductors in specific locations in the cable with the projections 60 of the cover molded to have a width in terms of the spacing between the cam surfaces 64, the flat surfaces 66, and the inside wall surface of wall 30 of the housing.

Figure 5:
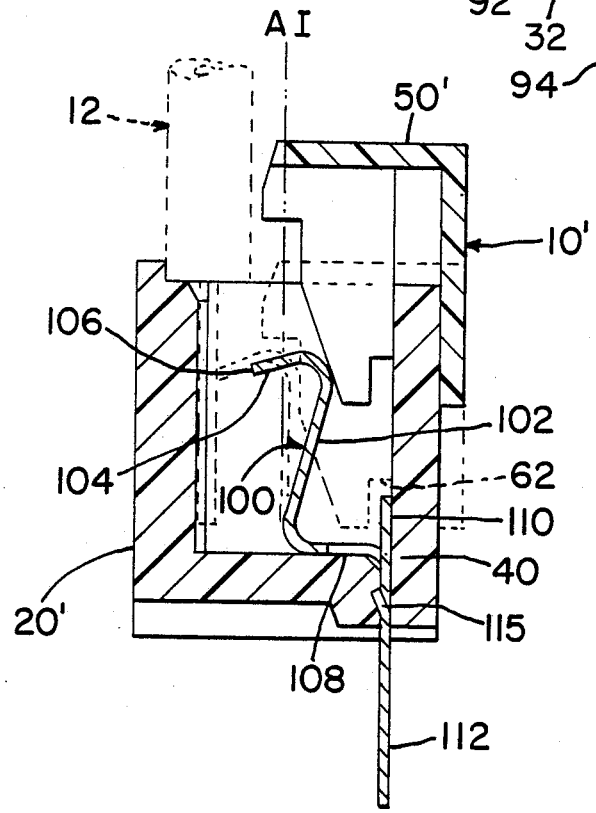
FIG. 5 shows a connector assembly in elevation partially sectioned, in accordance with the invention including a terminal of alternative construction showing the assembly in an unengaged position solidly and an engaged position in phantom.

Turning now to an alternative embodiment as shown in FIGS. 5 and 6, the general relationship of details of components as particularly with respect to the assembly shown as 10' including a housing 20' and a cover 50' may be seen when compared with the earlier described figures. The essential differences between the two embodiments relate to the configuration of the electrical terminal which is shown in these figures as element 100. The terminal 100 may be seen to include a first arm portion 102 extending in a generally vertical sense or parallel to the axis of insertion AI of both cover 50, and the multi-conductor cable 12 and further including a second arm portion 104 ending in a contact edge portion 106 which are interconnected with a curved portion to first arm portion 102. The difference here is that the second arm portion 104 extends away from the main axis of the terminal base portion 108 and the stabilizing tab portion 110. The terminal further includes a tab portion 112 terminated in a beveled portion 114 having the identical function to the terminal heretofore described. Tab portion 112, at its upper part, may be provided with a lance projection 115 to engage a complementary slot in housing 20' to thereby latch such terminal to the housing.

The essential advantage of the terminal 100 in its geometry construction with respect to the terminal 80 heretofore described is that it may be used in conjunction with the terminal 80 in alternate cavities whereby to place the tabs 94 and 112, respectively, on opposite sides of the cavities and of the housing 20 to provide a wider spacing along a given row of the tabs. There is in the embodiment of FIGS. 5 and 6 a further difference relating to the relief shown as 63 in the projection of the cover intended to provide clearance with respect to the stabilizing portion 110 of the terminal.

Figures 7, 8:
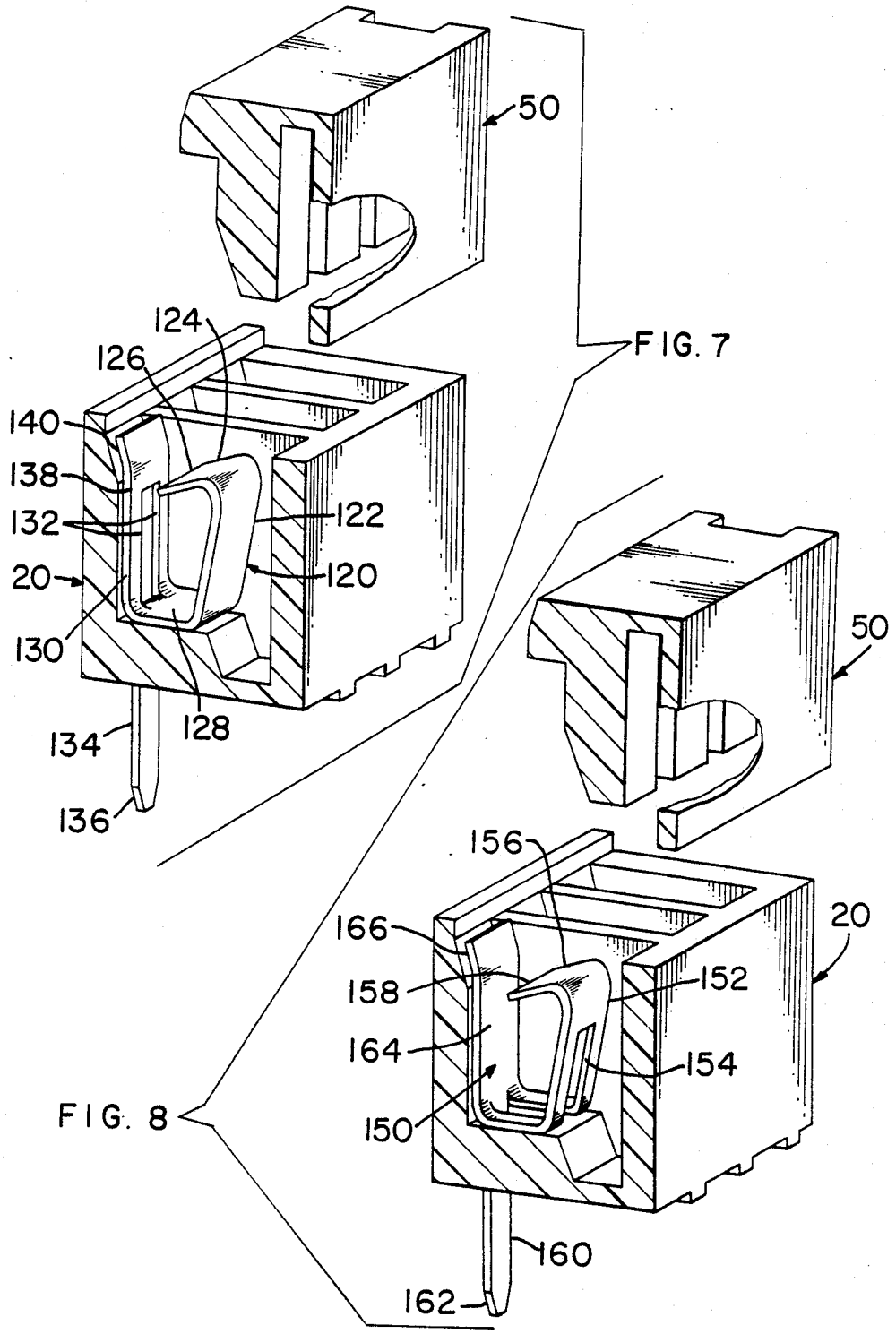
FIG. 7 and FIG. 8 show the assembly of the invention in an alternative embodiment of terminals, the views being perspectives partially sectioned for details of the functioning elements.

Referring now to FIG. 7, the connector assembly is shown with respect to base housing 20 and cover 50 utilizing a terminal 120 of different construction, an alternative terminal embodiment. The terminal 120 may be seen to include the first vertical arm portion 122 which includes a curved portion joining a second arm portion 124 ending in a contact portion 126 generally identical in shape to that shown with respect to terminal 80 in FIGS. 1–4. Its position within the cavity of the housing is also similar to that shown with respect to FIGS. 1–4, but there is further included a base portion 128 which joins a further upstanding or vertical portion 130 which includes two arms 132 formed by stamping out the tab portion 134 which is beveled as in earlier embodiments as at 136 to facilitate insertion within the aperture of a printed circuit board. The upper portion of 130 includes a flat surface portion 138 beveled as at 140 to facilitate guiding a conductor within the terminal. In the embodiment shown in FIG. 7, the operation of the assembly works as previously described with the projections of cover 50 driving the terminal arm portion 122 to cause the edge surface to bite into a previously inserted conductor, forcing the conductor to be trapped in engagement between the edge surface 126 and the portion 138 of the terminal, thus making for a metal-to-metal contact with respect to this terminal as compared to a metal-to-plastic contact with respect to the earlier described embodiments. In certain applications and particularly with respect to the higher power applications where more metal contact is called for, the embodiment of FIG. 7 may be preferred.

Turning now to FIG. 8, the housing assembly is shown with the base 20 and the housing cover 50 essentially as previously described with respect to FIGS. 1–4 there being a further embodiment of the terminal shown as 150. The terminal 150 includes, in this embodiment, a vertical arm 152 bifurcated by virtue of a slot 154 but including the curved portion joining second arm 156 ending in an edge surface 158. The tab portion shown as 160, beveled as at 162, is struck from the slotted portion 154, and there is provided adjoining thereto, a vertically oriented terminal portion 164 which is beveled at the top portion 166 to provide guidance for the insertion of a conductor. The distinction between the embodiment shown in FIG. 8 and the embodiment shown in FIG. 7 is that the bifurcation of the terminal in FIG. 8 extends into the cantilevered spring area to provide a more resilient spring for a given thickness and hardness of the flat stock from which the terminal is formed. The embodiment of FIG. 8 would be preferred in applications calling for a wider range of conductor sizes as heretofore mentioned.

The embodiment of FIG. 8 would also provide the additional metal-to-metal contact as described with respect to FIG. 7.

We claim:

1. An electrical connector assembly for connecting the conductors of a flat flexible multi-conductor cable to another circuit member, comprising a housing having a plurality of cavities formed therein, means for receiving said cable, wherein exposed cable conductors are received in each said cavity, a formed electrical terminal in each said cavity for electrical contact with said exposed conductors, and a cover engageable with said housing, whereby said formed electrical terminal comprises a first arm angled to the vertical direction, a flanged portion at one end thereof defining a second arm having an end thereof adapted to engage said exposed conductor, and said cover includes projections to be received in said cavities, where said each projection is provided with a cam surface to engage said first arm as said cover is brought into engagement with said housing operable to bring each said flange portion into electrical contact with a corresponding exposed conductor.

2. An electrical connector assembly according to claim 1, whereby each electrical terminal includes a leg to project through the base of said housing for mounting same to a printed circuit board or the like.

3. An electrical connector assembly according to claim 1, whereby said housing and said cover include matable latching means for securing said cover to said housing.

4. An electrical connector assembly for connecting an electrical conductor to an electrical terminal comprising a housing having at least one cavity formed therein, adapted to receive a conductor inserted therein along a given axis, a formed electrical terminal within said cavity adapted to be interconnected to said conductor, said terminal including a first arm having a flat formed portion extending generally along said given axis in cantilever fashion and a second arm extending from the end region of said first arm through a curved portion in a direction at right angles to said given axis, said second arm including an edge end adapted to engage said conductor to effect an interconnection therewith, cover means adapted to engage said housing including a cam surface positioned to bear against said first arm and cam said first arm toward said conductor as said cover is inserted into said cavity to force the said end into biting and connecting engagement with said conductor, the said second arm and the said first arm having an angular relationship whereby the axis of the second arm is oriented to hold said edge against said conductor to preclude withdrawal of said conductor from said housing.

5. An electrical connector or assembly for connecting the electrical conductors of a flat flexible multi-conductor cable to electrical terminals wherein there is provided a housing having a plurality of cavities formed therein adapted to receive conductors inserted therein along a given axis, a formed electrical terminal within each said cavities adapted to be interconnected to each said conductor as inserted in said cavity, said terminal including a first arm extending generally along said given axis in cantilever fashion and a second arm extending from the end region of said first arm in a sense at right angles of said given axis, said second arm carrying a sharp edged end adapted to engage and bite into a conductor to effect interconnection therewith, a cover means adapted to engage said housing including a cam surface adapted to engage said first arm and cam said first arm towards said conductor to force said end into contact therewith, the said second arm and the said first arm having an angular relationship whereby to provide a flexible pressure of terminal to conductor to accommodate conductors of different dimensions.

6. A connector assembly according to claim 5 wherein there is provided a latch means in the surface of said housing and cover to hold said housing in a first position allowing insertion of the said conductors and in a second position to hold said cam in engagement with said terminals.

7. A connector assembly according to claim 5 wherein there is provided a latching means including a plurality of cam latch projections adapted to fit within slot means disposed within said cover to effectively position said cover in a first position of disengagement and upon operation, a second position of engagement with the said terminals.

8. A connector assembly according to claim 5 wherein said terminal includes a further projection extending along said cavity wall opposite said first arm whereby said connector is forced against said further projection to provide metal-to-metal contact therewith as said first arm is biased by said cam surface of said cover projection.

9. A connector assembly according to claim 8 wherein said terminal includes a bifurcated section extending along said first arm to enhance the spring characteristics of said terminal.

10. A connector assembly according to claim 5 wherein each said terminal includes a tab extending through said housing for connection to further circuit paths and means are provided to latch said terminal to said housing.

11. A connector assembly according to claim 7 wherein said flat flexible multi-conductor cable may be inserted into or extracted from said housing in said first position with zero force.

* * * * *